US009315996B2

(12) United States Patent
Kuo et al.

(10) Patent No.: US 9,315,996 B2
(45) Date of Patent: Apr. 19, 2016

(54) PARTITION AND CONSTRUCTION METHOD THEREOF

(71) Applicants: Heng-Sheng Kuo, New Taipei (TW); Yu-Feng Kuo, New Taipei (TW)

(72) Inventors: Heng-Sheng Kuo, New Taipei (TW); Yu-Feng Kuo, New Taipei (TW)

( * ) Notice: Subject to any disclaimer, the term of this patent is extended or adjusted under 35 U.S.C. 154(b) by 0 days.

(21) Appl. No.: 14/454,323

(22) Filed: Aug. 7, 2014

(65) Prior Publication Data

US 2015/0040493 A1 Feb. 12, 2015

(30) Foreign Application Priority Data

Aug. 8, 2013 (TW) ..... 102128414
Sep. 25, 2013 (TW) ..... 102217873
Sep. 25, 2013 (TW) ..... 102217876

(51) Int. Cl.
*E04C 2/52* (2006.01)
*E04B 2/44* (2006.01)
(Continued)

(52) U.S. Cl.
CPC ... *E04C 2/52* (2013.01); *E04B 2/44* (2013.01); *E04B 2/54* (2013.01); *E04C 2/34* (2013.01); *E04C 2/46* (2013.01); *E04C 2/521* (2013.01); *E04F 13/0803* (2013.01); *E04F 13/0866* (2013.01); *E04F 13/0869* (2013.01); *E04C 2002/3488* (2013.01)

(58) Field of Classification Search
CPC ..... E04C 2/52; E04C 2/34; E04C 2/46; E04C 2002/3488; E04C 3/06; E04C 3/09; E04C 5/06; E04C 3/07; E04C 2003/0434; E04C 2003/0421; E04B 2/44; E04B 2/54; E04B 2/8647; E04B 2002/867; E04B 2/8641; E04B 2/7457; E04F 13/0803; E04F 13/0866; E04F 13/0869
See application file for complete search history.

(56) References Cited

U.S. PATENT DOCUMENTS 3,822,521 A * 7/1974 Lucas ..... 52/282.4
4,007,570 A * 2/1977 Hunter ..... 52/317
(Continued)

FOREIGN PATENT DOCUMENTS

JP H06-108566 A 4/1994
JP H10-140709 A 5/1998
(Continued)

OTHER PUBLICATIONS translation of Onoda JPH06108566 by Espacenet at: http://translationportal.epo.org/emtp/translate/?ACTION=description-retrieval&COUNTRY=JP&ENGINE=google&FORMAT=docdb&KIND=A&LOCALE=en_EP&NUMBER=H06108566&OPS=jp.espacenet.com/ops&SRCLANG=ja&TRGLANG=en.*
(Continued)

*Primary Examiner* — Brian D Mattei
(74) *Attorney, Agent, or Firm* — Chun-Ming Shih; HDLS IPR Services

(57) ABSTRACT

A partition includes at least two stands (1) spaced apart from each other, wherein each of the stands (1) includes a first panel (11), a second panel (12) corresponding to the first panel (11) and a lateral plate (13) connecting the first panel (11) and the second panel (12); at least one inner plate (3), wherein two sides of the inner plate (3) are respectively fixed to and between the two stands (1); and two outer plates (4, 5) respectively fixed to and between the first panel (11) of each stand (1) and the second panel (12) of each stand (1), wherein the two outer plates (4, 5) and the inner plate (3) form two spaces (6, 7) respectively. The inner plate 3 separates the two spaces (6, 7), so the partition is capable of performing better sound insulation effects and is more convenient to be assembled.

6 Claims, 22 Drawing Sheets

(51) Int. Cl.

| | |
|---|---|
| ***E04B 2/54*** | (2006.01) |
| ***E04C 2/34*** | (2006.01) |
| ***E04B 2/00*** | (2006.01) |
| ***E04F 13/08*** | (2006.01) |

(56) References Cited

U.S. PATENT DOCUMENTS

| | | | | |
|---|---|---|---|---|
| 4,170,857 | A * | 10/1979 | Rieger | 52/513 |
| 4,472,919 | A * | 9/1984 | Nourse | 52/601 |
| 6,145,257 | A * | 11/2000 | Cappuccio | 52/220.2 |
| 6,247,280 | B1 * | 6/2001 | Grinshpun et al. | 52/309.12 |
| 7,836,657 | B1 * | 11/2010 | diGirolamo et al. | 52/712 |
| 2003/0037494 | A1 * | 2/2003 | Collins et al. | 52/220.7 |
| 2009/0205277 | A1 * | 8/2009 | Gibson | 52/309.9 |
| 2010/0212243 | A1 * | 8/2010 | Lesoine | 52/317 |
| 2013/0104490 | A1 * | 5/2013 | Daudet et al. | 52/655.1 |
| 2014/0157707 | A1 * | 6/2014 | Knoll et al. | 52/481.2 |

FOREIGN PATENT DOCUMENTS

| | | | |
|---|---|---|---|
| JP | H11-350635 | A | 12/1999 |
| JP | 2004-176449 | A | 6/2004 |
| TW | 537341 | U | 6/2003 |
| TW | I259070 | B | 8/2006 |
| TW | M335542 | U | 7/2008 |

OTHER PUBLICATIONS

Office Action dated Jul. 14, 2015 of the corresponding Japanese patent application.

Technical Evaluation Report dated Feb. 17, 2015 of the corresponding Taiwan Utility Model application.

* cited by examiner

PARTITION AND CONSTRUCTION METHOD THEREOF

TECHNICAL FIELD

The disclosure relates to a partition, more particularly to a partition applied in the construction and the construction method thereof.

BACKGROUND

A partition may refer to a partition wall in the building, a ceiling, a floor or an outer wall on the outside of a building, and the following content takes the partition wall as an example.

In the construction process, an upper rail and a ground rail are firstly disposed on the ceiling and the ground respectively, and then multiple U-shaped stands are installed between the upper rail and the ground rail. Subsequently, a first outer plate is used to cover one side of the stand and sound insulation materials are disposed between the upper rail, the ground rail, the stands and the first outer plate. Lastly, a second outer plate is used to cover the other side of the stands.

In the current construction process, however, the water and electricity pipeline connects the opposite sides of the sound insulation materials so the effect of sound insulation is poor.

Moreover, the current construction process is difficult to conduct. Firstly, a large number of screwing elements are required to fasten the sound insulation materials, thereby causing problems in the current construction process. Secondly, during the arrangement of the pipeline, a second processing procedure is needed in order to damage the sound insulation material, which leads to extra processing time and extra processing procedures. This makes the construction process even more difficult.

Furthermore, currently two ends of the bar protrude from the outermost two stands so they need to be cut off, which is troublesome. On the other hand, the two ends of the bar cannot suspend in midair because it makes the outermost stands unable to be connected with any bar, which may have a negative impact on the construction strength and makes the whole structure prone to be damaged.

SUMMARY

The disclosure provides a partition and the construction method thereof. By the particular structure of the partition and the particular construction method, the two spaces are completely separated by the inner plate so the sound insulation effects are better and the partition is easier to be assembled.

For reaching the purposes mentioned above, the disclosure provides a partition comprising at least two stands spaced apart from each other, wherein each of the stands comprises a first panel, a second panel corresponding to the first panel and a lateral plate connecting the first panel and the second panel; at least one inner plate, wherein two sides of the inner plate are respectively fixed to and between the two stands; and two outer plates respectively fixed to and between the first panel of each stand and the second panel of each stand, wherein the two outer plates and the inner plate form two spaces respectively.

Furthermore, a construction method for a partition is provided and comprises the steps of: assembling at least two stands, wherein the two stands are spaced apart and disposed between an upper rail and a ground rail, each of the stands comprises a first panel, a second panel corresponding to the first panel and a lateral plate connecting the first panel and the second panel; fixing an outer plate, wherein the outer plate is fixed to and between the first panels of the two stands; arranging a water and electricity pipeline, wherein a first water and electricity pipeline is arranged between the two stands and an inner surface of the outer plate; fixing at least one inner plate, wherein two sides of the inner plate are respectively fixed to and between the two stands, the outer plate and one surface of the inner plate form a space for accommodating the first water and electricity pipeline; arranging another water and electricity pipeline, wherein a second water and electricity pipeline is arranged between the two stands and another surface of the inner plate; and fixing another outer plate, wherein another outer plate is fixed to and between the second panels of the two stand, and another space for accommodating the second water and electricity pipeline is formed between the another outer plate and the another surface of the inner plate.

Moreover, another construction method for a partition is provided and comprises the steps of: assembling at least two stands, wherein the two stands are spaced apart and disposed between an upper rail and a ground rail, each of the stands comprises a first panel, a second panel corresponding to the first panel and a lateral plate connecting the first panel and the second panel; fixing at least one inner plate, wherein two sides of the inner plate are respectively fixed to and between the two stands; arranging two water and electricity pipelines, wherein a first water and electricity pipeline and a second water and electricity pipeline are arranged on two surfaces of the inner plate; and fixing two outer plates, wherein the two outer plates are respectively fixed to and between the first panels of the two stands and the second panels of the two stands, and a space for accommodating the first water and electricity pipeline is formed between the outer plate and the surface of the inner plate while another space for accommodating the second water and electricity pipeline is formed between the another outer plate and the another surface of the inner plate.

Compared to Prior Art, the benefits of the disclosure include better sound insulation effects and more convenient assembly processes.

BRIEF DESCRIPTION OF THE DRAWINGS

The disclosure will become more fully understood from the detailed description and the drawings given herein below for illustration only, and thus does not limit the present disclosure, wherein.

DETAILED DESCRIPTION

Figure 1:
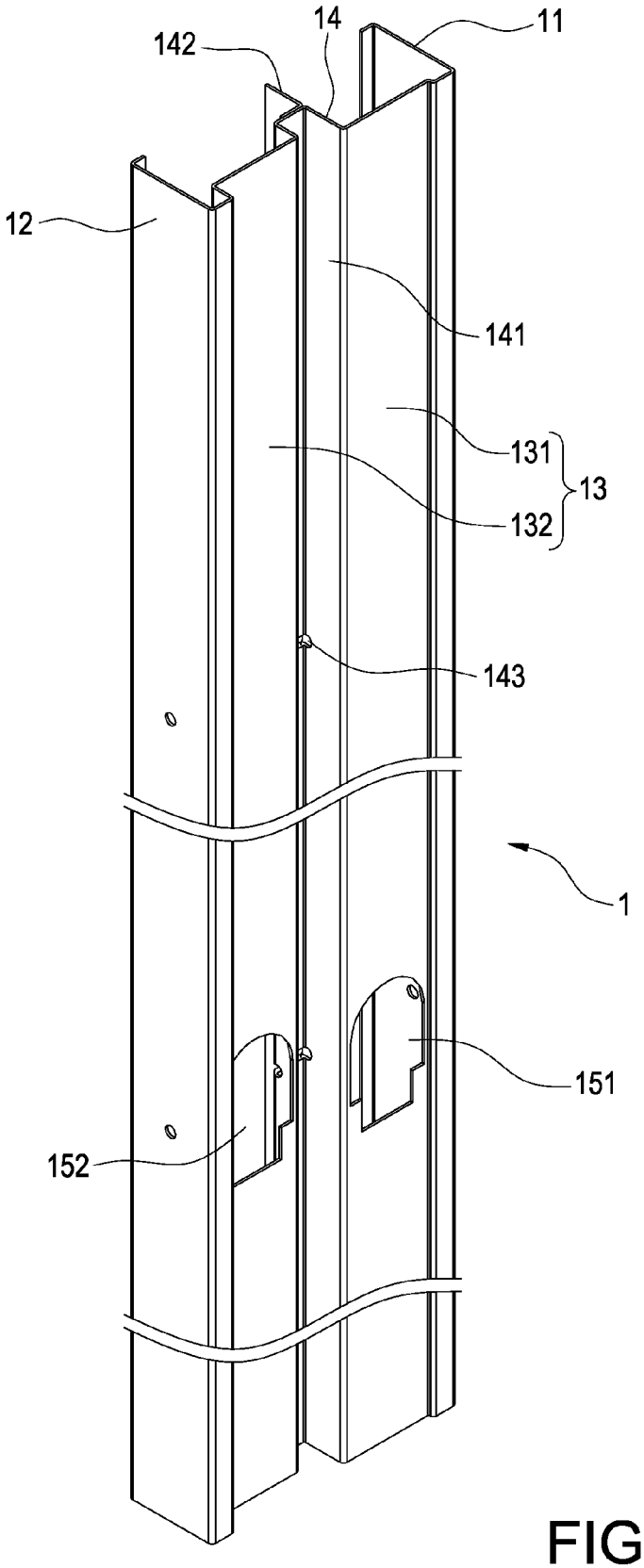
FIG. 1 is a perspective view of a stand according to the first embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 7:
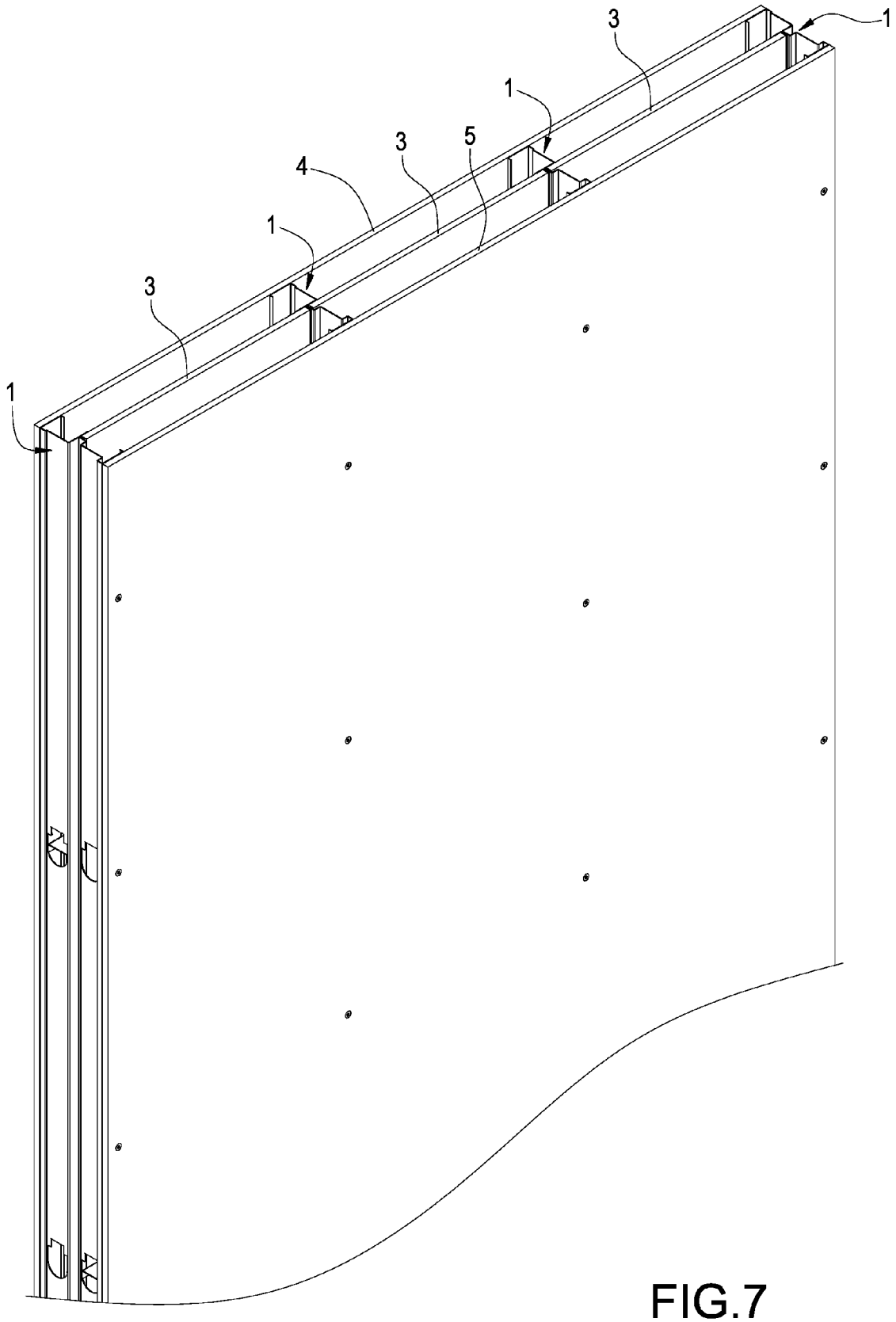
FIG. 7 is a perspective view of another outer plate fixed to and between the second panels of the two stands according to the first embodiment of the disclosure.
Figure 8:
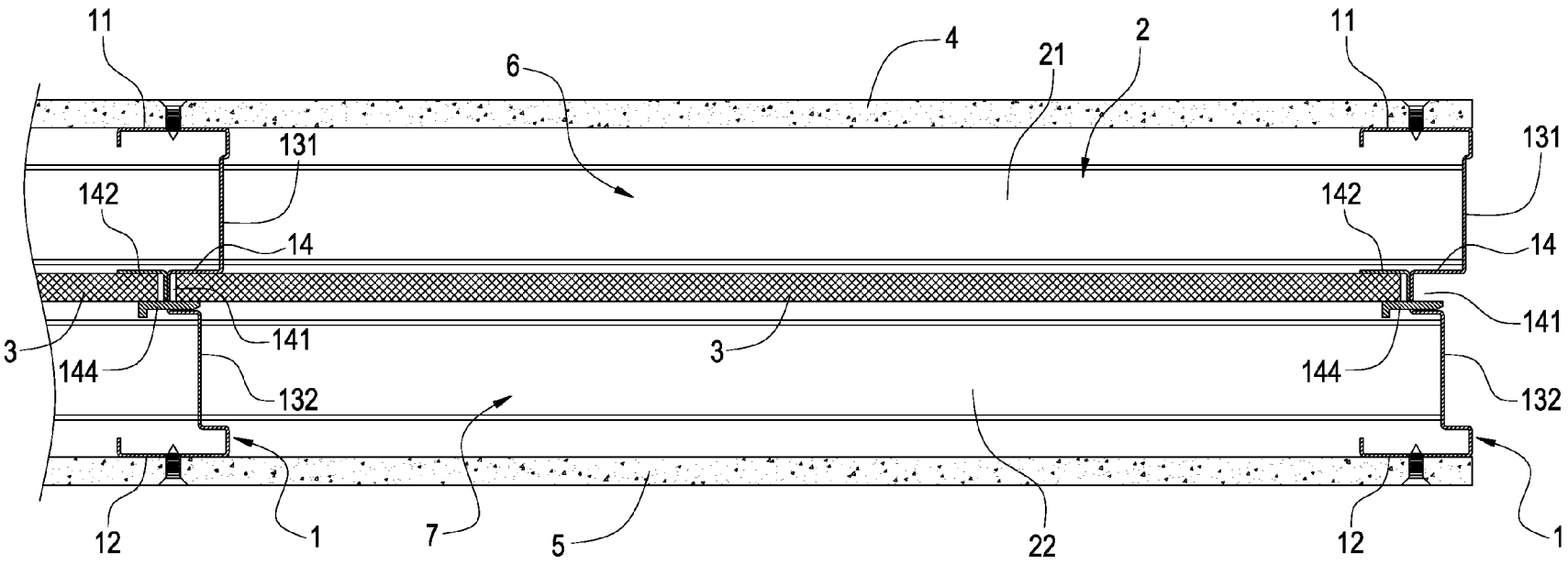
FIG. 8 is a sectional view of FIG. 7.

Referring to FIG. 7 and FIG. 8 which are a perspective view and a top view of the partition respectively, as an example, the disclosure provides a partition and a construction method thereof. The partition may be a partition wall in a building, a ceiling, a floor or an outer wall on the outside of a building, and the following embodiments use the partition wall as an example to illustrate.

As seen in FIG. 1 to FIG. 8, the partition of the first embodiment comprises a plurality of stands 1, a plurality of inner plates 3 and two outer plates (including a first outer plate 4 and a second outer plate 5). In this embodiment, the partition further comprises a plurality of bars 2. For the purpose of illustration, the following description includes two stands 1, a first bar 21 (or a second bar 22), an inner plate 3, a first outer plate 4 and a second outer plate 5, as an example.

Figure 2:
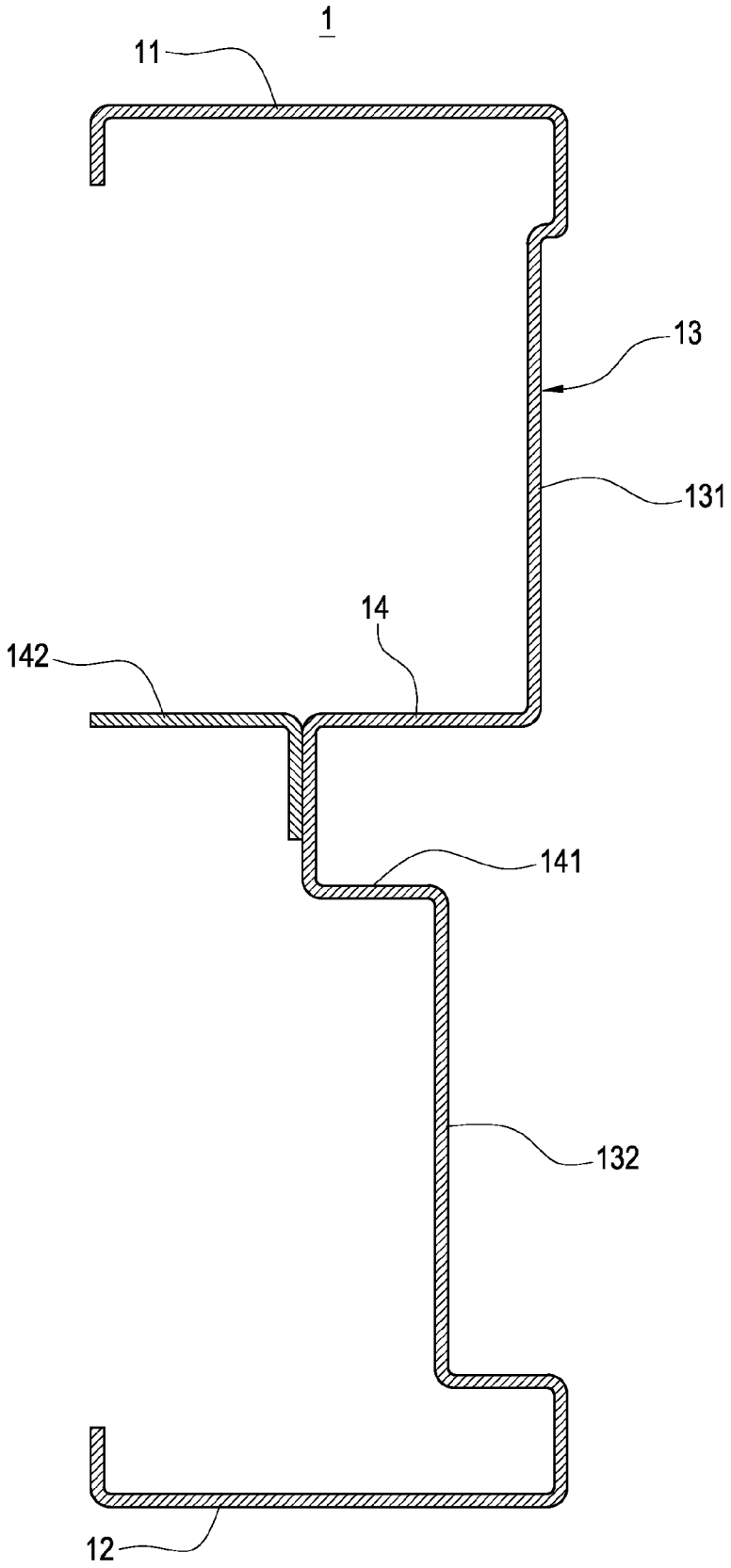
FIG. 2 is a sectional view of the stand according to the first embodiment of the disclosure.
Figure 3:
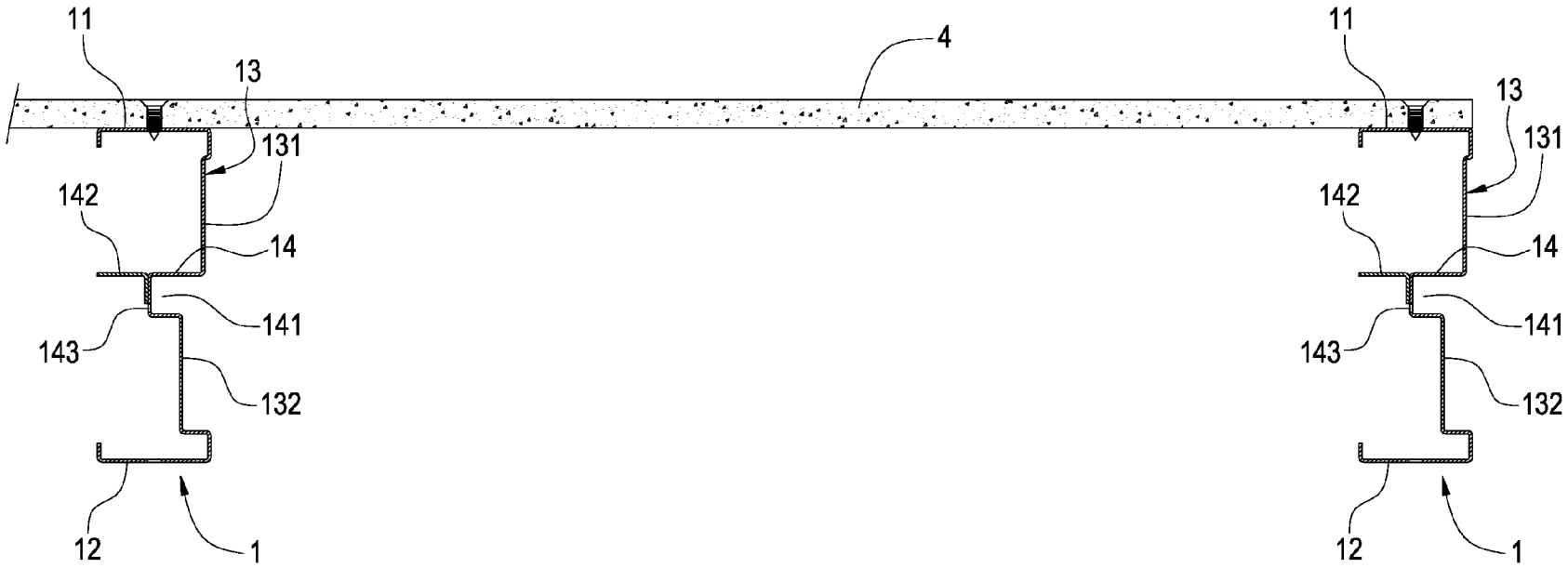
FIG. 3 is a sectional view of an outer plate fixed to and between the first panels of the two stands according to the first embodiment of the disclosure.
Figure 4:
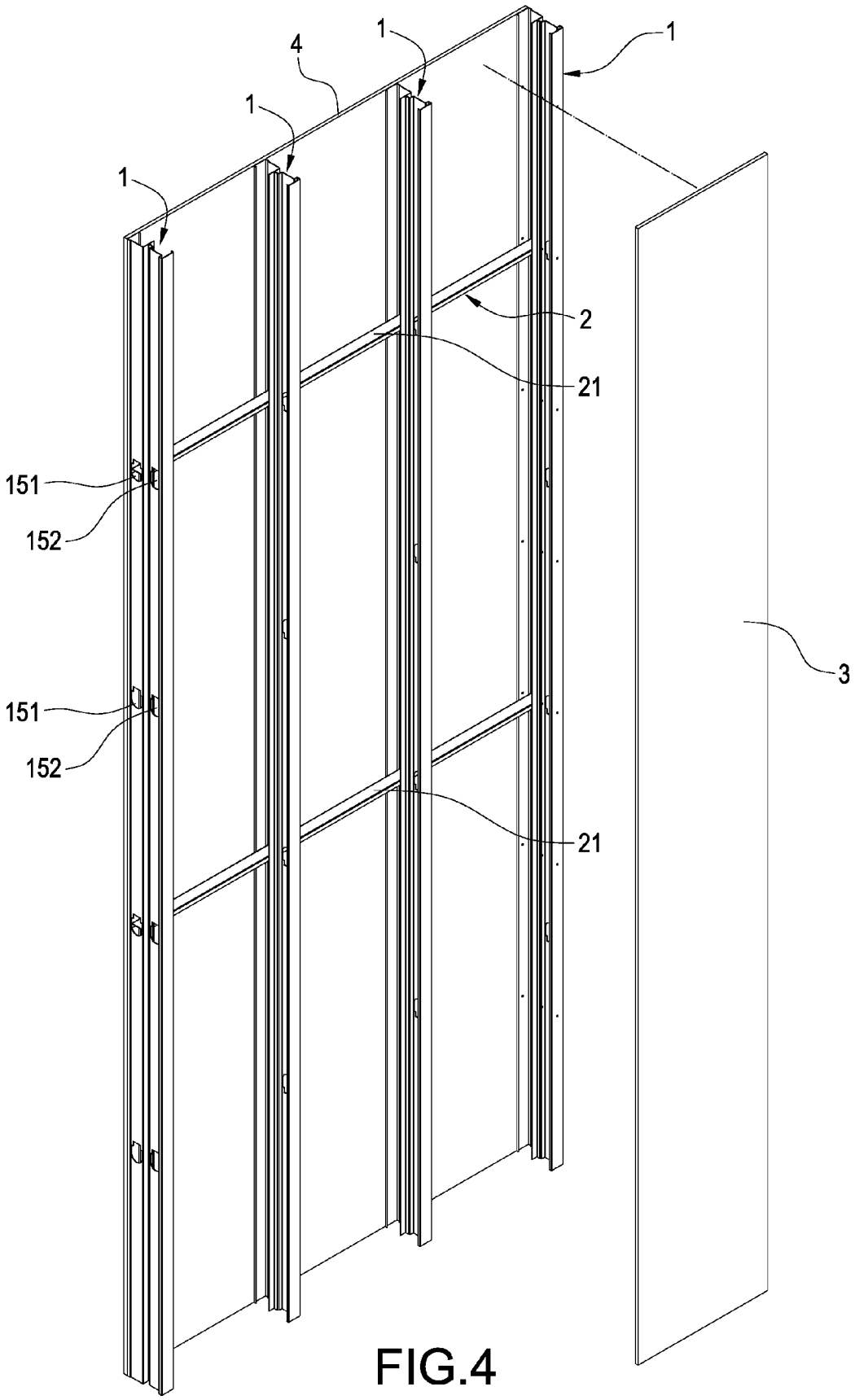
FIG. 4 is an exploded view of an inner plate assembled between the two stands according to the first embodiment of the disclosure.

The two stands 1 are spaced apart and are disposed between an upper rail and a ground rail (not shown in the figures) which are fixed to the ceiling and the ground of a building respectively (not shown in the figures). Each stand 1 comprises a first panel 11, a second panel 12 corresponding to the first panel 11 and a lateral plate 13 connecting the first panel 11 and the second panel 12. A lateral side of the lateral plate 13 protrudes (towards left, as seen in FIG. 2) and forms a bending portion 14, thereby making the lateral plate 13 form a groove 141 corresponding to the bending portion 14. Additionally, the lateral side of the lateral plate 13 has an extending plate 142 extending from the bending portion 14.

In this embodiment, the lateral plate 13 of each stand 1 is divided into a first lateral plate 131 and a second lateral plate 132 by the groove 141. At least one first through hole 151 is formed on the first lateral plate 131 (shown in FIG. 1 and FIG. 4). At least one second through hole 152 is formed on the second lateral plate 132. The bar 2 is inserted between two stands 1 selectively. For instance, a first bar 21 is inserted between the first through holes 151 of the two stands 1 (shown in FIG. 4) or a second bar 22 is inserted between the second through holes 152 of the two stands 1 (not shown in the figures). Further, as seen in FIG. 7, the first and second bars 21 and 22 can each be inserted between the first through hole 151 and the second through hole 152, or the first bar 21 may be inserted between the first through holes 151 when the second bar 22 is inserted between the second through holes 152 (not shown in the figure). By using the first bar 21 and the second bar 22, the two stands 1 can be stabilized. In addition, the first panel 11 of each stand 1 can be at the same level and the second panel 12 of each stand 1 can also be at the same level, which makes the fixing processes of the first and second outer plates 4 and 5 easier.

The inner plate 3 has a left side and a right side opposite to each other. The left side of the inner plate 3 is plugged into the groove 141 of one stand 1 while the right side of the inner plate 3 is positioned on the extending plate 142 of the other stand 1. The extending plate 142 of each stand 1 comprises at least one positioning member 144. The positioning member 144 may be a screwing member for screwing the bending portion 14 and the inner plate 3 together (not shown in the figures), or it may be a latch bolt which is used in this embodiment.

Figure 5:
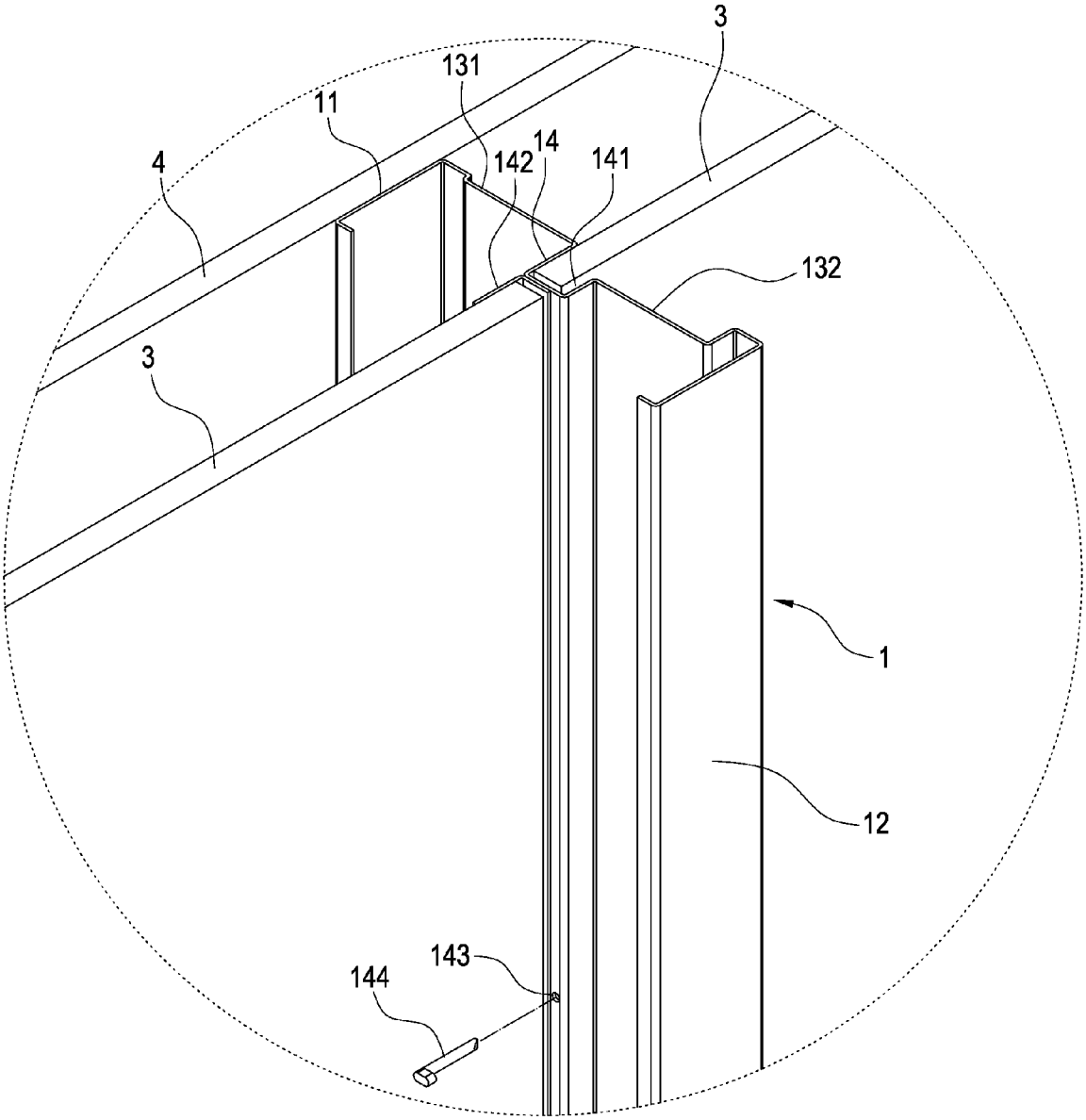
FIG. 5 is a partially enlarged view of FIG. 4 after assembling.

At least one socket 143 is formed on the bending portion 14 of each stand 1 (as seen in FIG. 5), in order for the positioning member 144 to be plugged in. The positioning member 144 is parallel to the lateral side of the lateral plate 13 and is plugged into the socket 143 of the stand 1 so that the left side and the right side of the inner plate 3 are sandwiched between (namely disposed between) the groove 141 and the positioning member 144 of one stand 1 (on the left) and between the extending plate 142 and the positioning member 144 of the other stand 1 (on the right), respectively.

Figure 6:
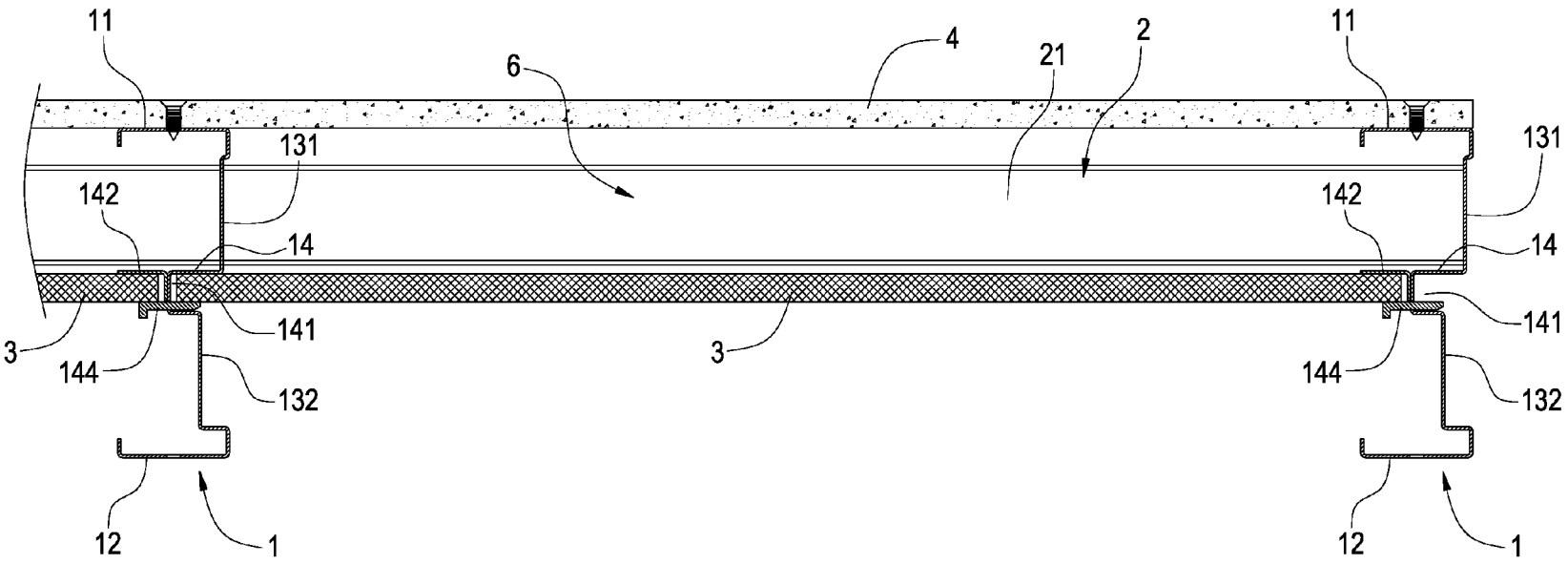
FIG. 6 is a sectional view of the inner plate of FIG. 4 after assembling.

Referring to FIG. 6, when installing the inner plate 3, the left side of the inner plate 3 is plugged into the groove 141 of the stand 1 on the left and then the right side of the inner plate leans on the extending plate 142 of the stand 1 on the right. Subsequently, the positioning member 144 is plugged into the sockets 143 of the two stands 1 such that the two sides of the inner plate 3 are able to be sandwiched, as mentioned above. The same positioning member 144 can also have an impact on the groove 141 and the extending plate 142 of the single stand 1. That is, similar to the stand 1 on the left, it is capable of sandwiching the right side of the left inner plate 3 and the left side of the right inner plate 3.

The first outer plate 4 is fixed to and between the first panel 11 of each stand 1 while the second outer plate 5 is fixed to and between the second panel 12 of each stand 1. Thus, two spaces are formed between the first outer plate 4 and the inner plate 3. Specifically, a first space 6 is formed between the first outer plate 4 and the inner plate 3 while a second space 7 is formed between the second outer plate 5 and the inner plate 3. The first space 6 and the second space 7 are for the water and electricity pipeline (not shown in the figures) to be arranged in without damaging the inner plate 3. In other words, the first space 6 and the second space 7 do not connect with each other. Furthermore, the first space 6 and the second space 7 are completely separated by the inner plate 3, which results in better sound insulation effects than the prior art. Even better sound insulation effects can be achieved when the inner plate 3 is made of sound insulation materials. However, the disclosure is not limited thereto. The inner plate 3 may also be made of fireproof material or foam material.

Moreover, the partition further comprises a filler material (not shown in the figures). The filler material may be foam material or any other material as long as it can be filled in. The filler material is filled in the first space 6 and the second space 7 after the arrangement of the water and electricity pipeline is finished.

Figure 9:
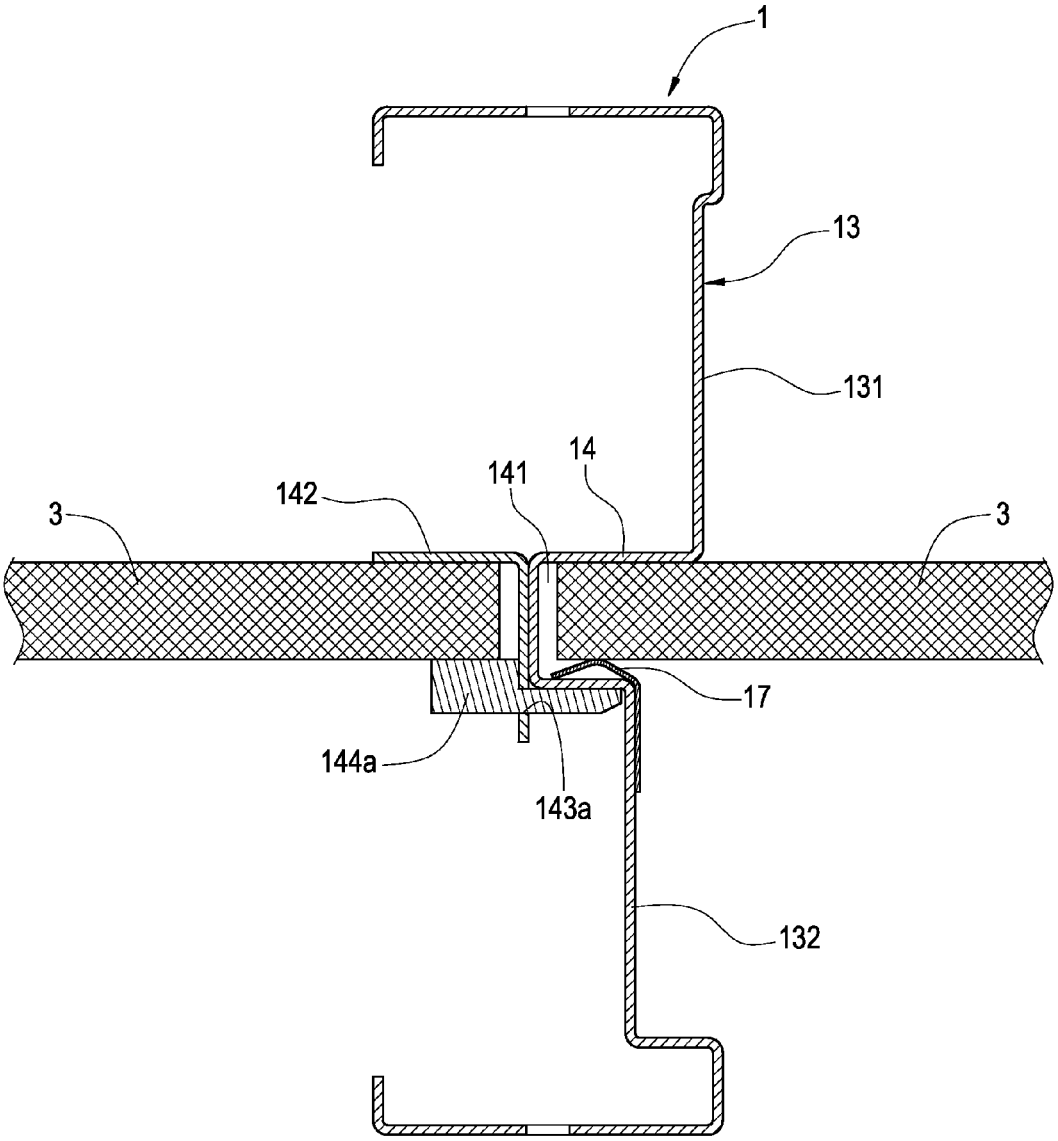
FIG. 9 is a sectional view of another stand of the disclosure.
Figure 10:
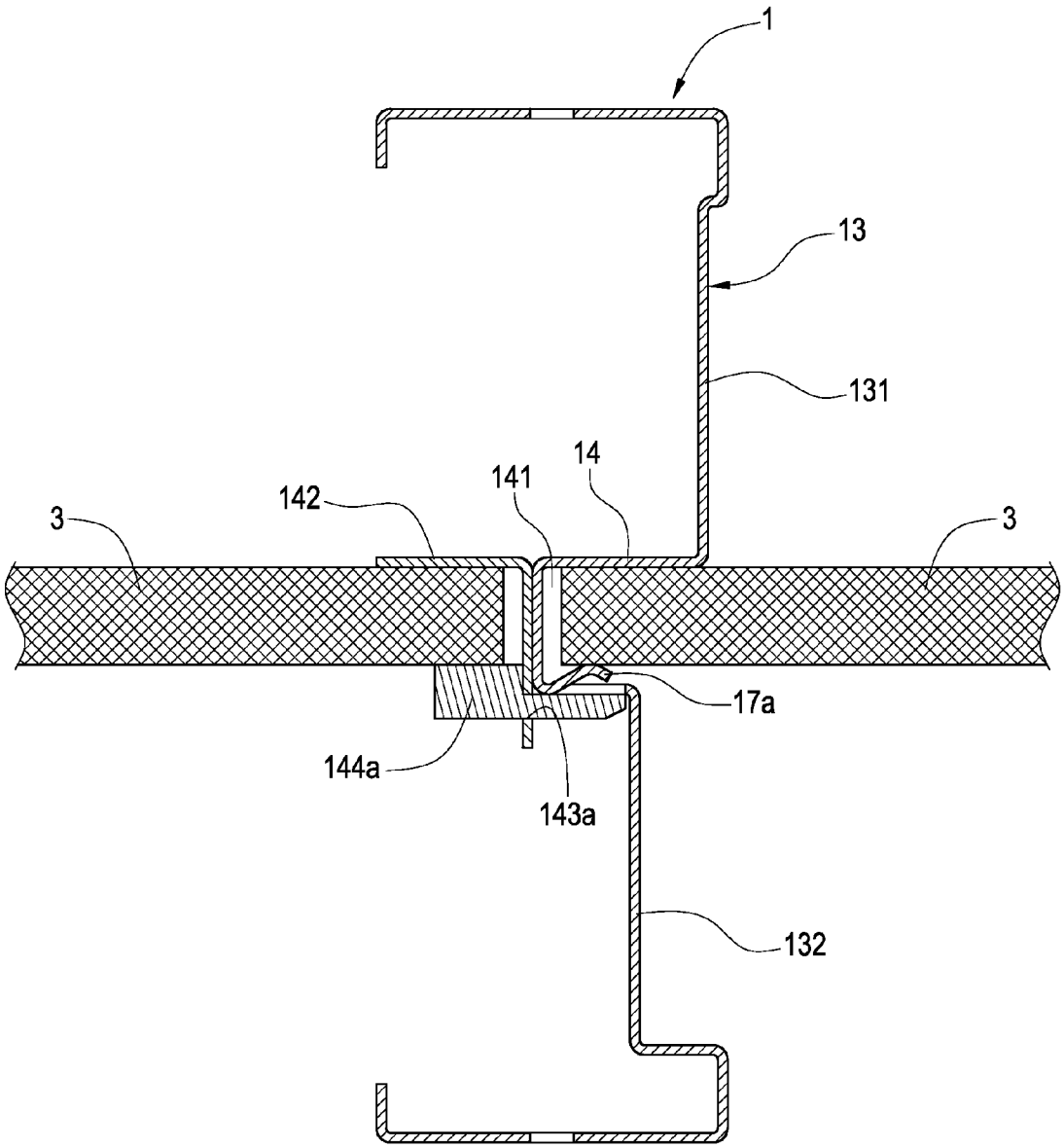
FIG. 10 is a sectional view of still another stand of the disclosure.

FIG. 9 and FIG. 10 show another stand 1 and still another stand 1, respectively. At least one elastic sheet 17 or 17*a* is disposed on the bending portion 14 of each stand 1 and protrudes towards the groove 141. Thereby, the inner plate 3 is disposed between (namely sandwiched between) the bending portion 14 and the elastic sheet 17 or 17*a*, flexibly. In FIG. 9, a part of the elastic sheet 17 is fixed to the lateral plate 13 while the other part extends towards the groove 141. In FIG. 10, the elastic sheet 17*a* and the bending portion 14 are integrally formed. Additionally, the number of the elastic sheets 17 and 17*a* in FIG. 9 and FIG. 10 is plural. The socket 143*a* is formed on another extending place of the extending plate 142 so that the positioning member 144*a* is able to be plugged in the socket 143*a*. Thereby, the positioning member 144*a* and the extending plate 142 can sandwich another inner plate 3.

Figure 11:
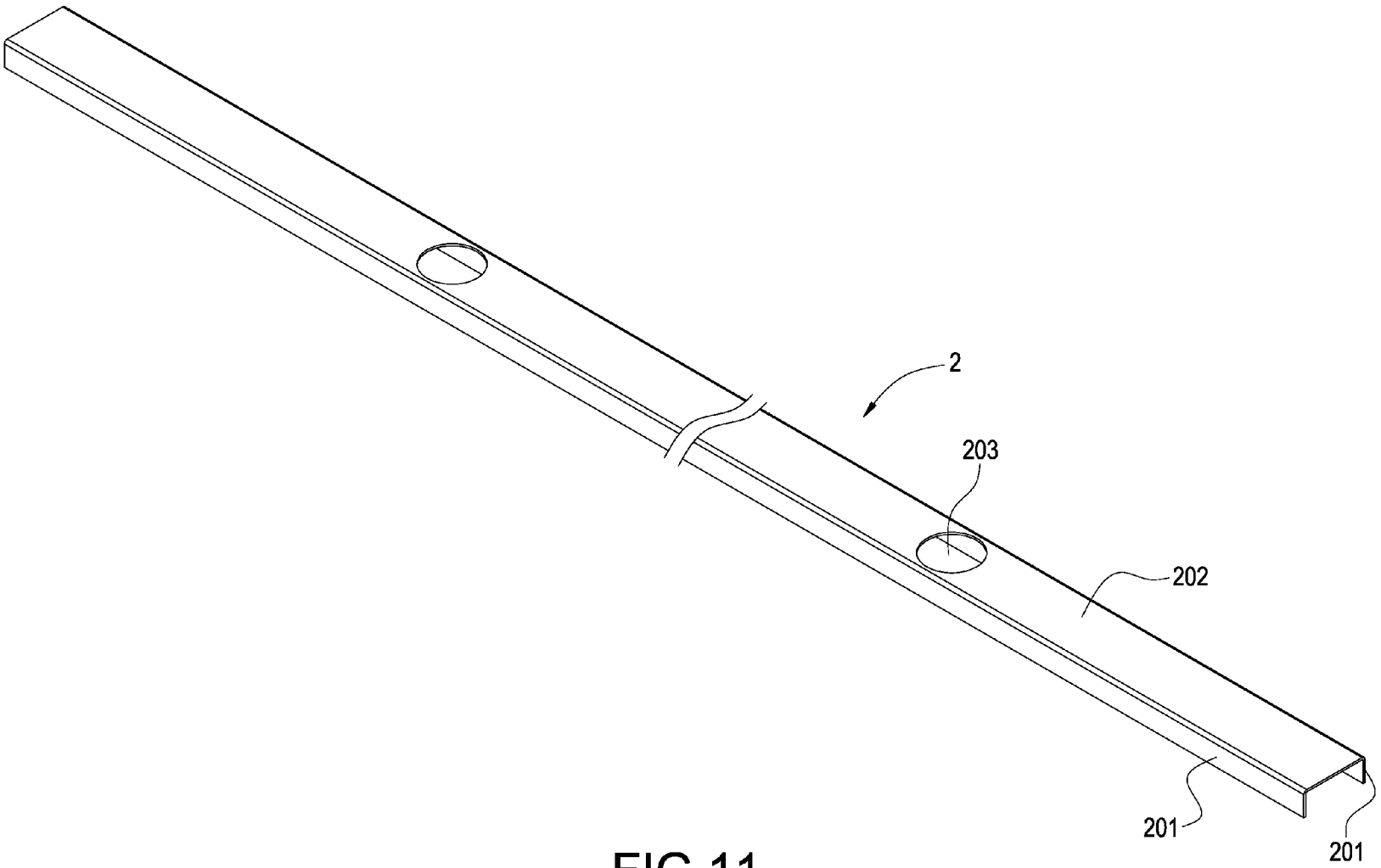
FIG. 11 is a perspective view of a bar according to the second embodiment of the disclosure.
Figure 12:
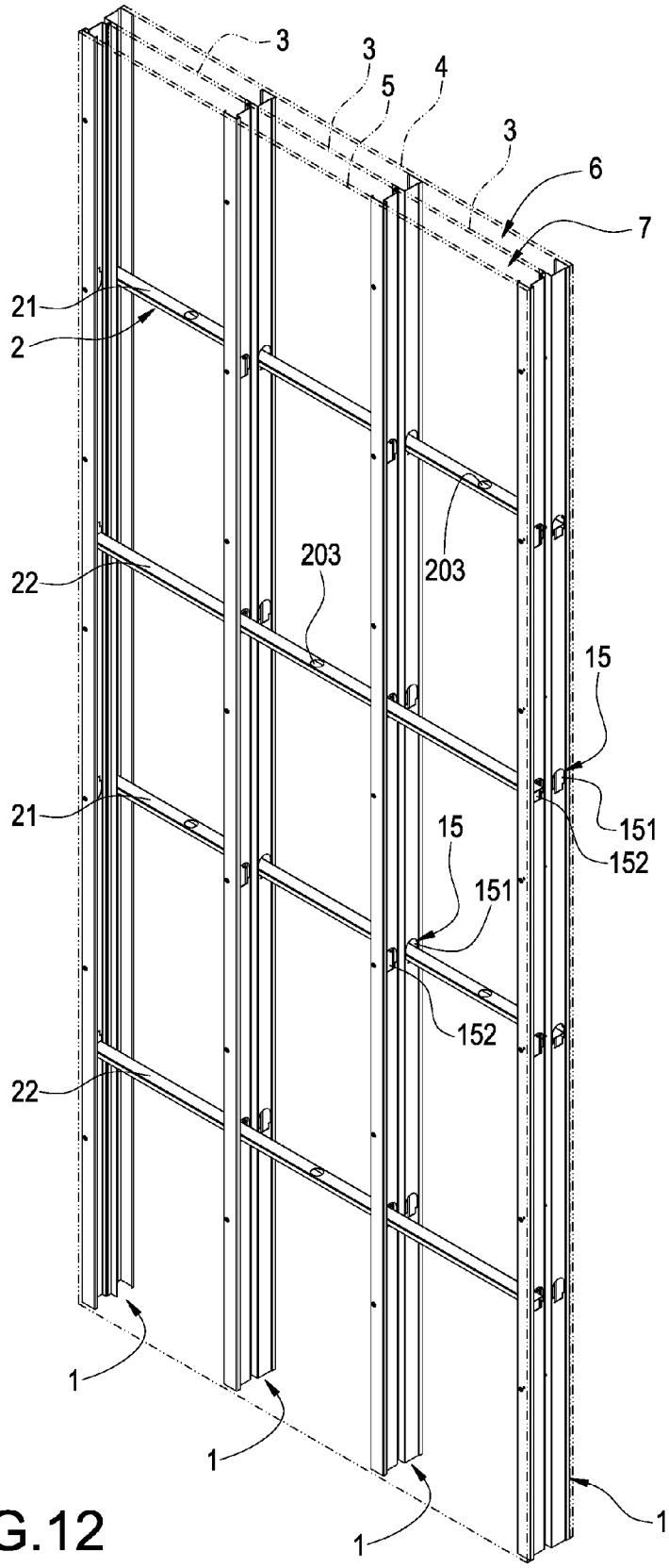
FIG. 12 is a perspective view of the second embodiment of the disclosure after assembling.
Figure 13:
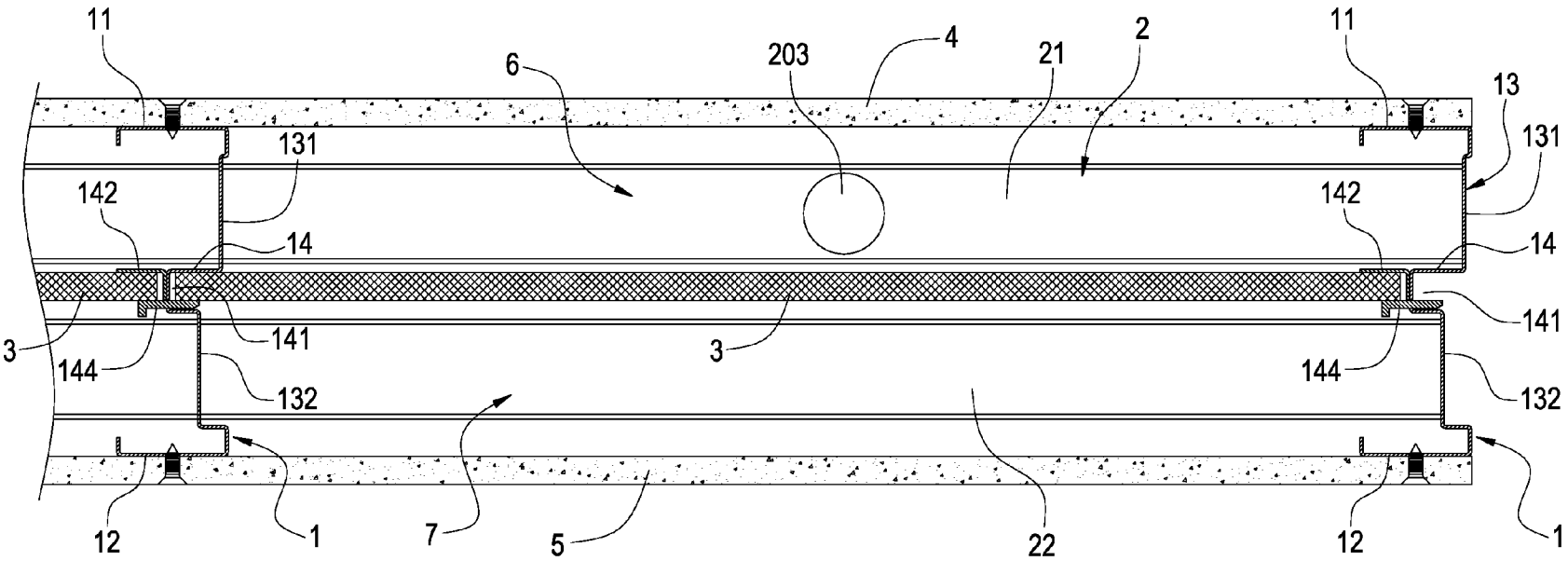
FIG. 13 is a sectional view of FIG. 12.

The second embodiment of the partition is shown in FIG. 11 to FIG. 13. Though not shown in these figures, the water and electricity pipeline is arranged in it. As seen in the figures, the second embodiment is similar to the first embodiment and the differences are that the pipeline hole 203 is added on the bar 2 for the water and electricity pipeline to go through.

As seen in FIG. 11 and FIG. 12, the bar 2 comprises two flanks 201 and a middle plate 202, thereby forming a reversed U-shaped bar. The two flanks 201 correspond to each other and the middle plate 202 connect one side of each flank 201. The aforementioned pipeline hole 203 is formed on the middle plate 202 for the water and electricity pipeline to go through. Alternatively, the bar 2 may comprise a first bar 21 and a second bar 22, and the pipeline hole 203 is formed on both the first bar 21 and the second bar 22 for the water and electricity pipeline to go through.

Referring to FIG. 13, a first space 6 and a second space 7 are formed between the first outer plate 4 and the inner plate 3 and between the second outer plate 5 and the inner plate 3, respectively. The first water and electricity pipeline (not shown in the figures) may be placed in the first space 6 and it goes through the pipeline hole 203 of the first bar 21. The second water and electricity pipeline (not shown in the figures) may be placed in the second space 7 and it goes through the pipeline hole 203 of the second bar 22. Hence, this does not need to damage the inner plate 3 even when arranging the first and second water and electricity pipelines, so the first space 6 and the second space 7 do not connect with each other.

FIG. 14 to FIG. 19 show a partition of the third embodiment which is similar to the first embodiment. However, two latching members 23 are added to two ends of the bar 2, thereby forming a bar structure. Moreover, the outermost stands are two stands 1 while the stands between them are middle stands 1*a*. A recessed groove is formed between the first panel 11, the second panel 12 and the lateral plate 13.

The bar structure comprises a bar 2 and the two latching members 23 disposed on two ends of the bar 2. Each latching member 23 comprises a latching plate 231 with friction (referring to FIG. 16). At least two sides of the latching plate 231 are fasten with the recessed groove 15 of each stand 1 by friction and thereby are fixed thereto.

Figure 16:
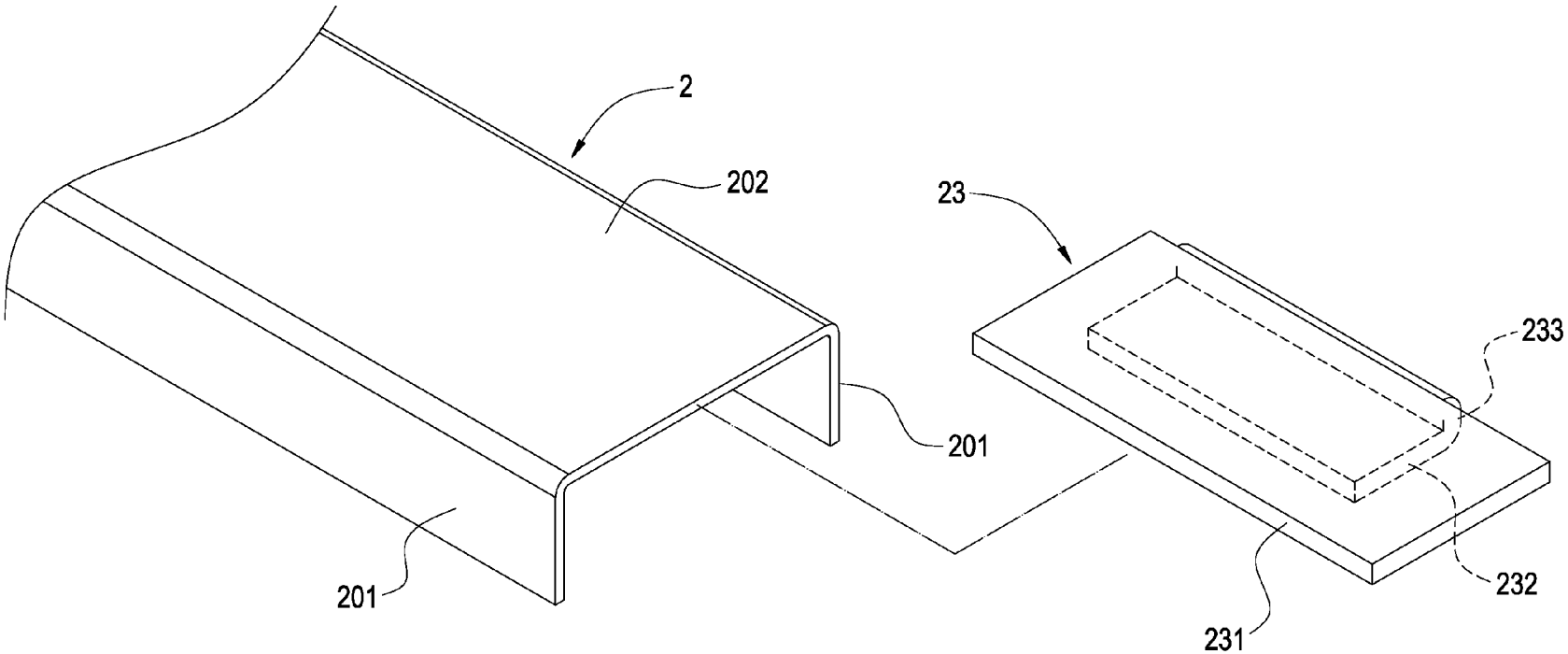
FIG. 16 is an exploded view of the bar and the latching member thereof according to the third embodiment of the disclosure.

In this embodiment, the bar 2 is a reversed U-shaped bar as seen in FIG. 16 and comprises two flanks 201 and a middle plate 202. The two flanks 201 correspond to each other and the middle plate 202 connect one side of each flank 201. By disposing the bar 2, the first panel 11 of each stand 1 can be at the same level and the second panel 12 of each stand 1 can also be at the same level, which makes the fixing processes of the first and second outer plates 4 and 5 easier.

Figure 17:
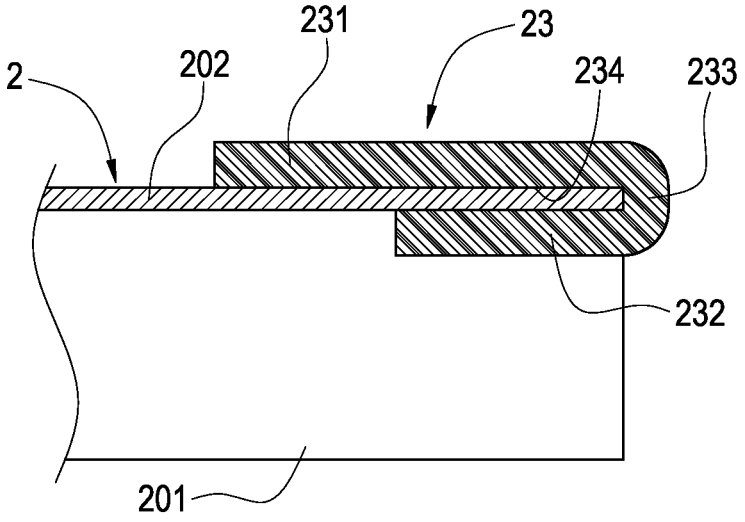
FIG. 17 is a sectional view of FIG. 16 after assembling.

Each latching member 23 may be a plastic latching member. As seen in FIG. 16, each latching member 23 further comprises a board 232 adjacent to one side of the latching plate 231 with space and a connecting body 233 connected with the side of the latching 231 with the board 233 located on. As seen in FIG. 17, a sandwiching portion 234 is formed between the latching plate 231 and the board 232. The sandwiching portion 234 of each latching member 23 sandwich and hold on the middle plate 202 of each end of the bar 2, detachably.

Figure 15:
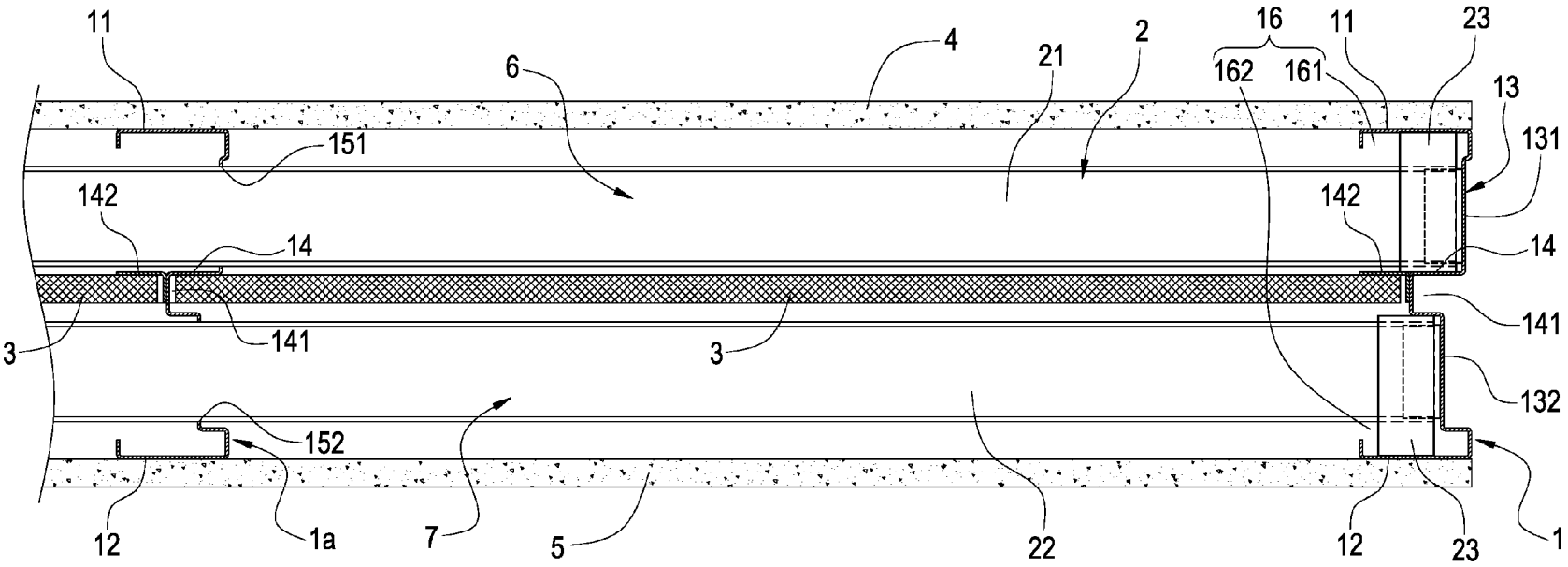
FIG. 15 is a sectional view of FIG. 14.
Figure 18:
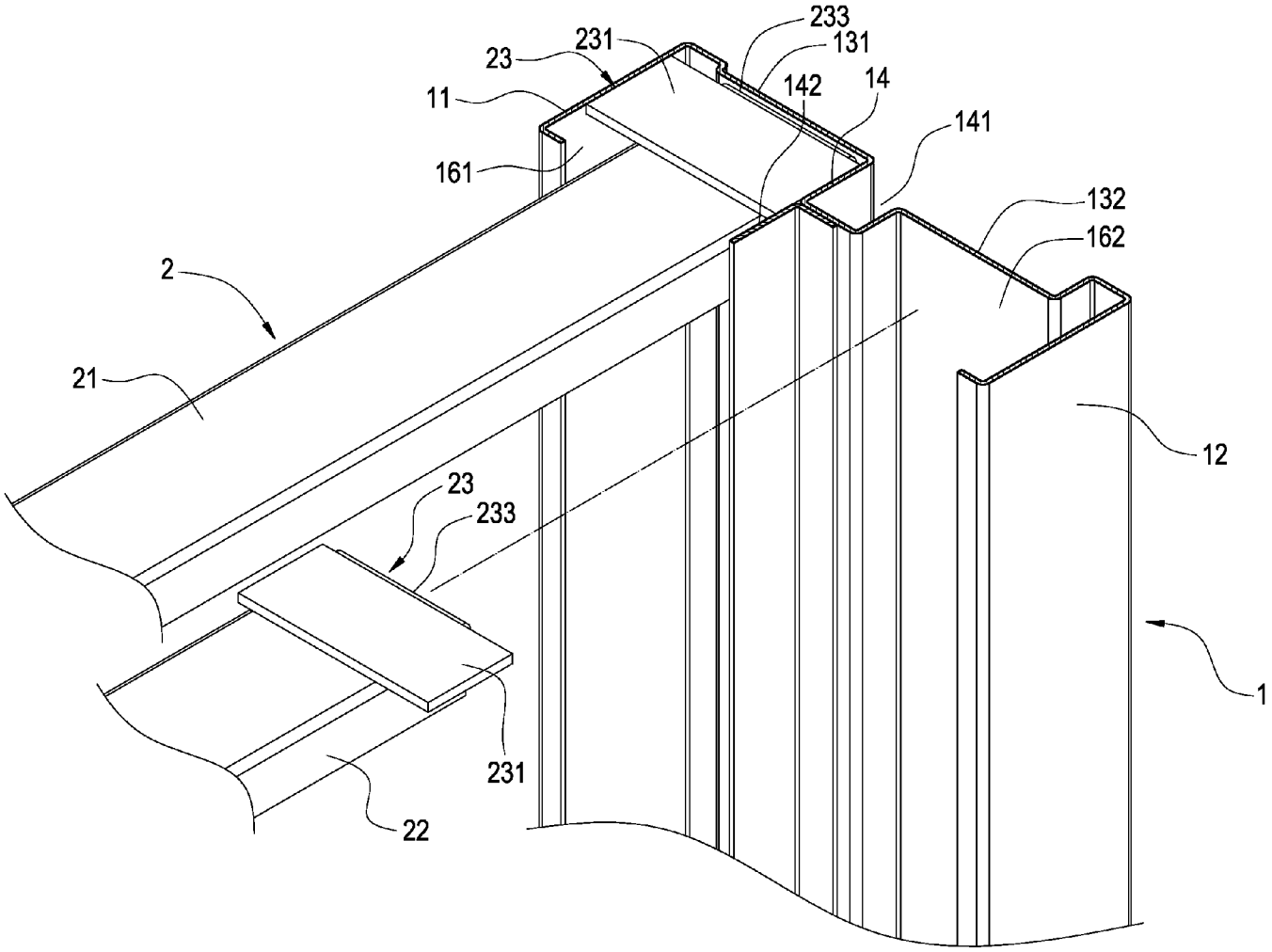
FIG. 18 is an exploded view of the bar using its latch member to be fasten with the stand according to the third embodiment of the disclosure.
Figure 19:
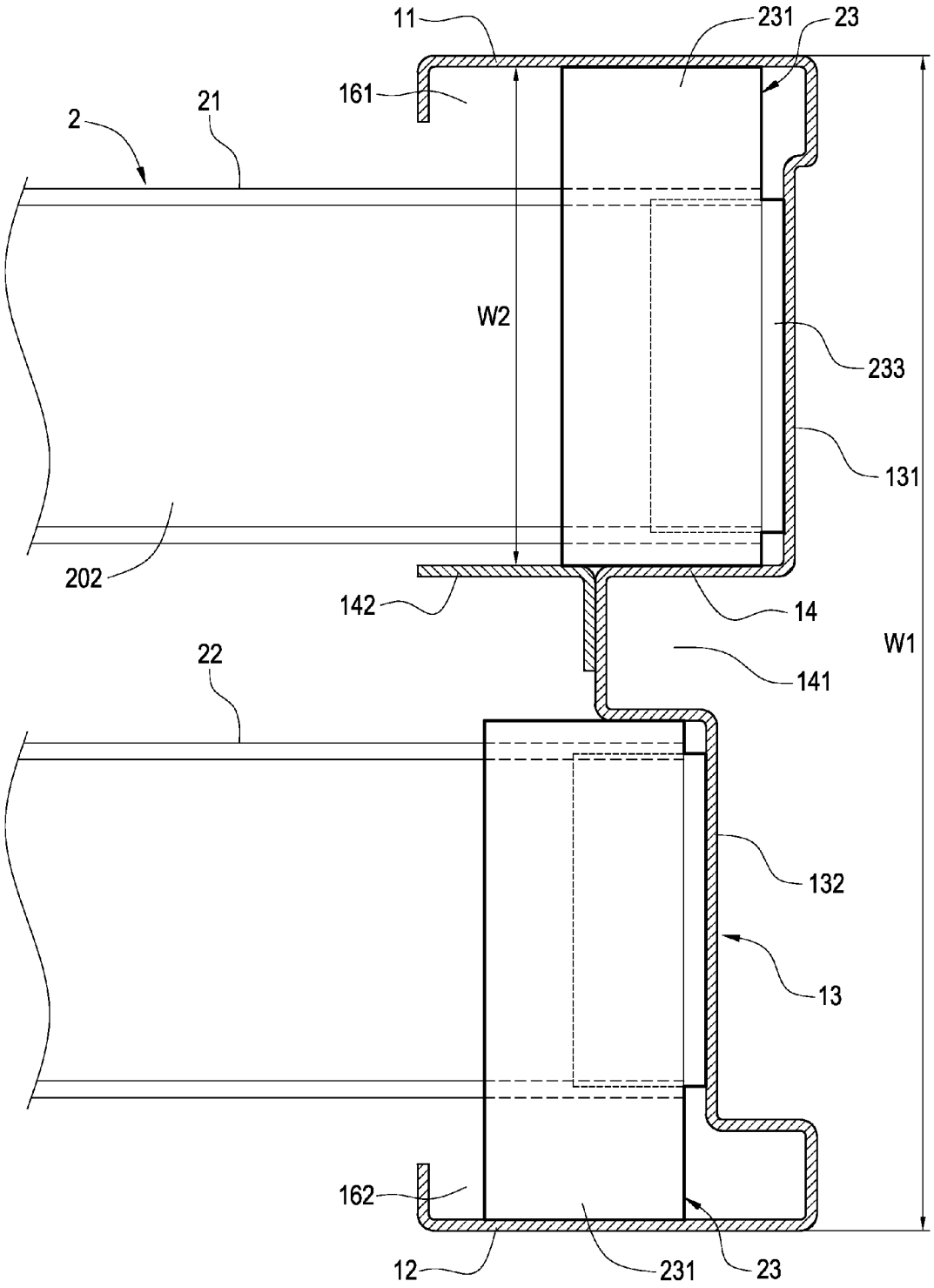
FIG. 19 is a schematically sectional view of FIG. 18 after assembling.

Referring to FIG. 15, FIG. 18 and FIG. 19, the recessed groove 16 of each stand 1 comprises a first recessed groove 161 and a second recessed groove 162 separated by the bending portion 14. The two latching member 23 of the bar 2 are fasten in the first recessed groove 161 of each stand 1 or the second recessed groove 162 of each stand 1 selectively. At this point, the forces of friction exist respectively between two sides of the latching plate 231 with the first panel 11 and the bending portion 14 of each stand 1, or exist respectively between two sides of the latching plate 231 with the bending portion 14 and the second panel 12 of each stand 1. Preferably, the connecting body 233 of the latching member 23 is also with friction and is fastened in the first recessed groove 151 or the second recessed groove 162 by friction. Thereby, the outer side of the connecting body 233 rubs against the inner side of the lateral plate 13 of each stand 1. As shown in FIG. 19, the width W2 of the first recessed groove 151 or the second recessed groove 162 is less than half the width W1 of the stand 1 for the purpose of generating the force of friction.

Figure 14:
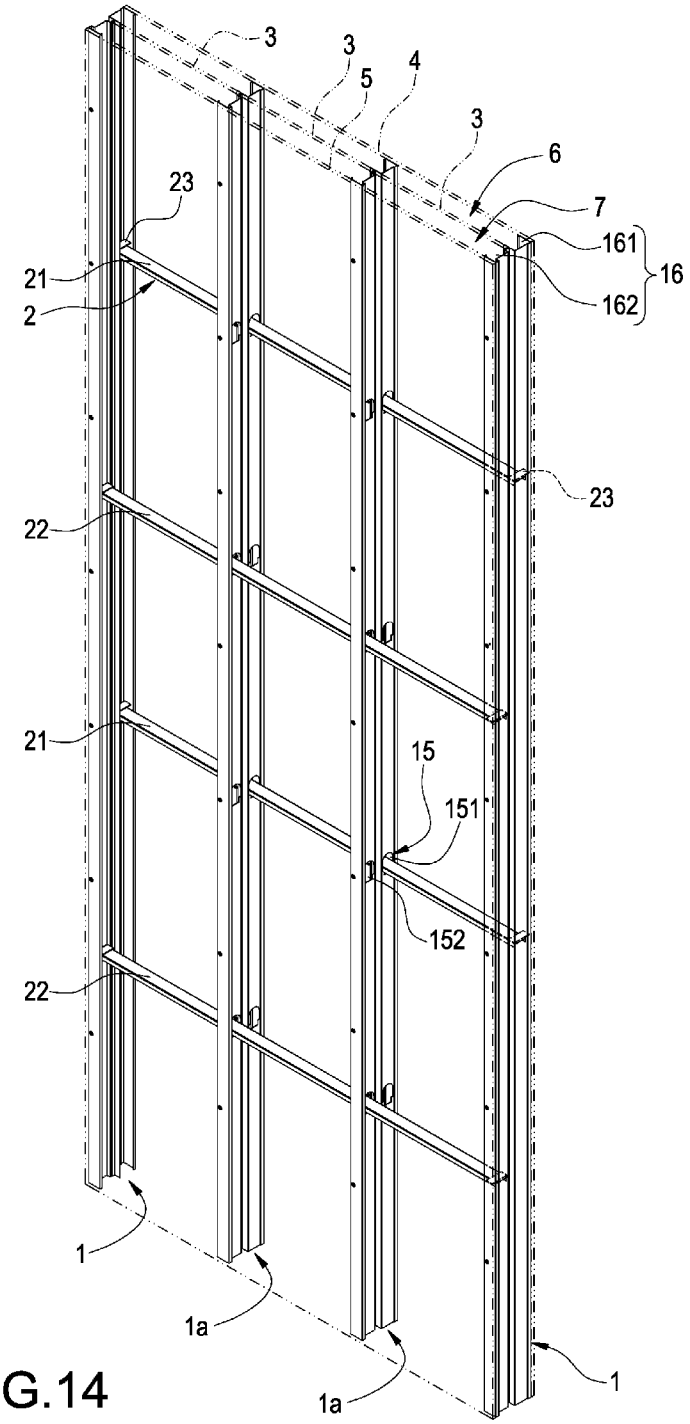
FIG. 14 is a perspective view of the third embodiment of the disclosure after assembling.

Referring to FIG. 14 and FIG. 15, the multiple middle stands 1*a* (disposed between two stands 1) are spaced apart from each other and the structure thereof is almost identical to that of the stand 1. Nonetheless, a through hole 15 is added on the stands 1*a* for the bar 2 to be inserted in. Specifically, the first and second through hole 151 and 152 are formed on the first and second lateral plates 131 and 132 respectively and the bar 2 is inserted between two middle stands 1*a* selectively.

Furthermore, as shown in FIG. 14 and FIG. 15, one side of the inner plate 3 is positioned on the extending plate 142 of one stand 1 while the other side is positioned on the extending plate 142 of the other stand 1. However, if one of the two stands 1 is put in a reversed direction (not shown in the figures), one side of the inner plate 3 is plugged in the groove 141 of one stand 1 while the other side is positioned on the extending plate 142 of the other stand 1.

Figure 20:
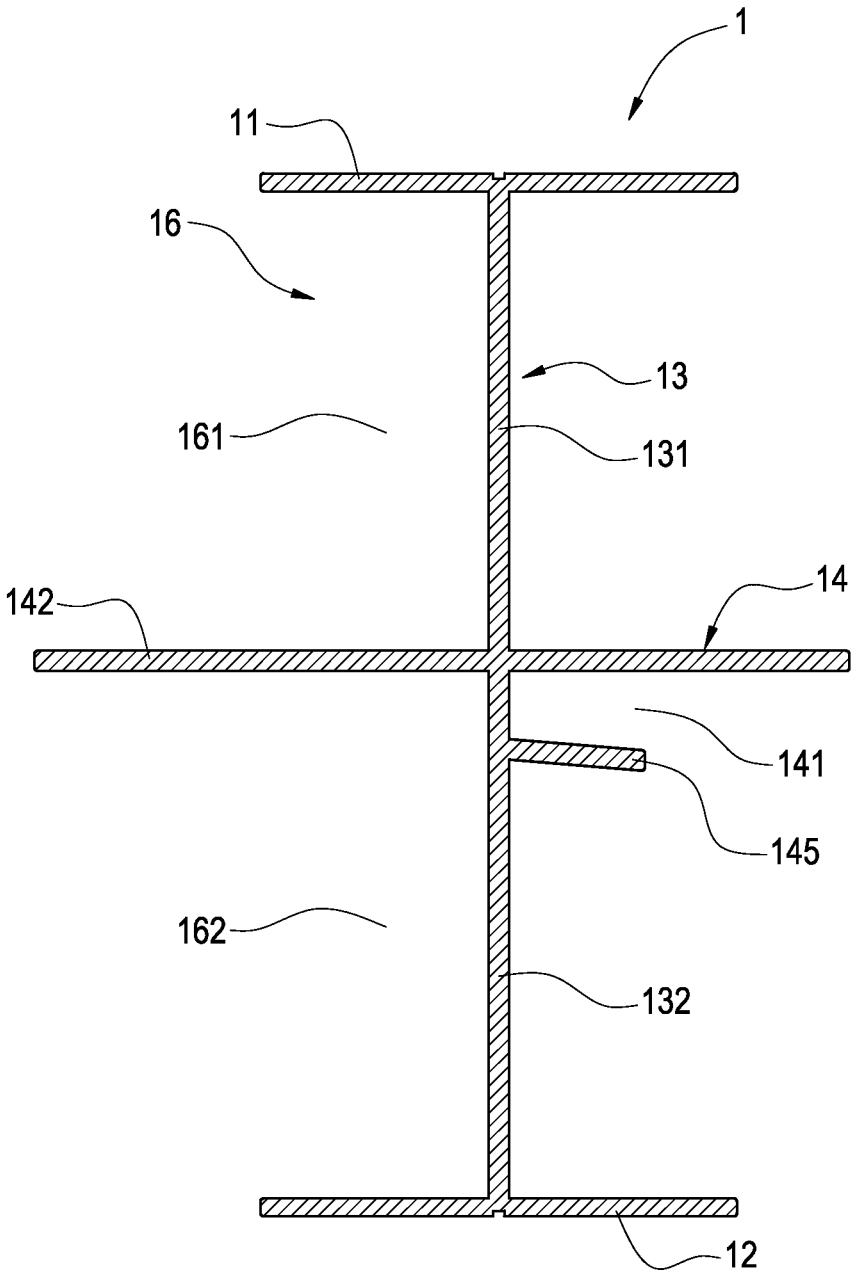
FIG. 20 is a sectional view of another stand of the disclosure.

FIG. 20 is a sectional view of another stand of the disclosure which is different from the E-shaped stand 1 seen in the sectional view before. As seen in FIG. 20, the sectional view of this stand 1 shows a double-E shape with a back-to-back connection. Besides, another extending plate 145 is added to form the groove 141 mentioned before. The effects of this stand 1 are similar to the stands 1 illustrated before so it will not be explained here again.

Figure 21:
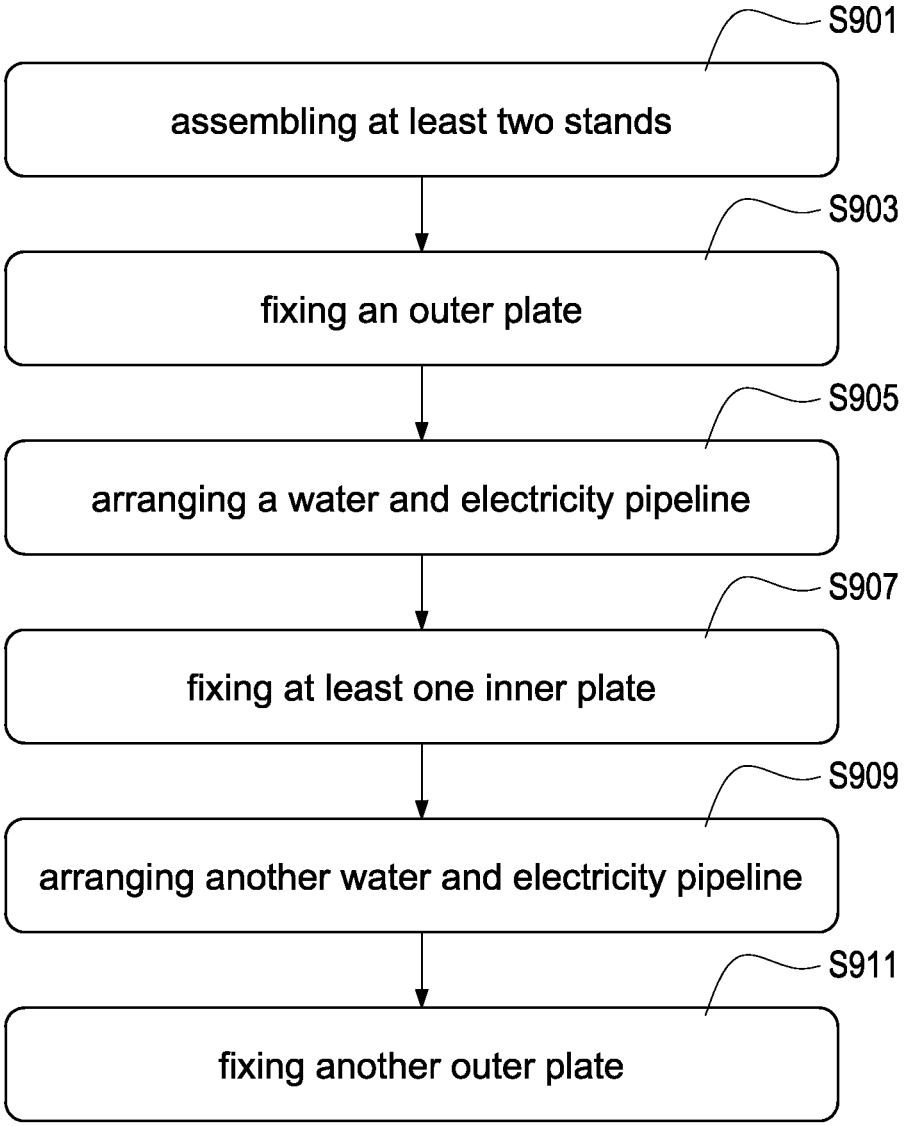
FIG. 21 is a flow chart of a construction method according to the first embodiment of the disclosure.

FIG. 21 is a flow chart of a construction method according to the first embodiment of the disclosure. Referring to FIG. 1 to FIG. 10 and FIG. 21, the construction method of the partition comprises the steps of: assembling at least two stands <S901>; fixing an outer plate <S903>; arranging a water and electricity pipeline <S905>; fixing at least one inner plate <S907>; arranging another water and electricity pipeline <S909>; and fixing another outer plate <S911>. In this embodiment, the steps further include installing a bar and filling a filler material (not shown in FIG. 21 and FIG. 22).

The partition of this embodiment comprises multiple stands 1, multiple bars 2, multiple inner plates 3 and two outer plates (including the first outer plate 4 and the second outer plate 5). For the purpose of illustration, however, the following description only includes two stands 1, a first bar 21 (or a second bar 22), an inner plate 3, a first outer plate 4 and a second outer plate 5, as an example.

In the step of assembling at least two stands <S901>, the two stands 1 are spaced apart and disposed between an upper rail and a ground rail (not shown in the figures), and the structure of the stand 1 is the same as the structure illustrated in previous embodiments.

In the step of installing the bar, the bar 2 is inserted between the first through hole 151 of each stand 1 or the second through hole 152 of each stand 1, selectively. For instance, a first bar 21 is inserted between the first through holes 151 of the two stands 1 or a second bar 22 is inserted between the second through holes 152 of the two stands 1. Further, the first and second bars 21 and 22 can each be inserted between the first through hole 151 and the second through hole 152, or the first bar 21 may be inserted between the first through holes 151 when the second bar 22 is inserted between the second through holes 152. This arrangement is not intended to limit the disclosure.

In the step of fixing an outer plate <S903>, the outer plate 4 is fixed to and between the first panels 11 of the two stands 1.

In the step of arranging a water and electricity pipeline <S905>, a first water and electricity pipeline is arranged between the two stands 1 and an inner surface of the outer plate 4 (not shown in the figures).

In the step of fixing at least one inner plate <S907>, two sides of the inner plate 3 (same as before) are respectively fixed to and between the two stands 1. The outer plate 4 and one surface of the inner plate 3 form a space 6 for accommodating the first water and electricity pipeline.

In the step of arranging another water and electricity pipeline <S909>, a second water and electricity pipeline is arranged between the two stands 1 and another surface of the inner plate 3 (not shown in the figures).

In the step of fixing another outer plate <S911>, another outer plate 5 is fixed to and between the second panels 12 of the two stands 1. Another space 7 for accommodating the second water and electricity pipeline is formed between the another outer plate 5 and the another surface of the inner plate 3.

In the step of filling a filler material, the filler material is filled into the first and second spaces 6 and 7. The partition is constructed by the construction procedures mentioned above (see FIG. 7 and FIG. 8).

In the step of assembling at least two stands <S901>, a socket 143 is formed on the bending portion 14. The extending plate 142 comprises at least one positioning member 144. Each of the positioning members 144 is parallel to the lateral side of the lateral plate 13 and is plugged into the socket 143 of each stand 1. Two sides of the inner plate 3 are respectively disposed between the groove 141 and the positioning member 144 of one of the stands 1 and between the extending plate 142 and the positioning member 144 of the other stand 1.

Figure 22:
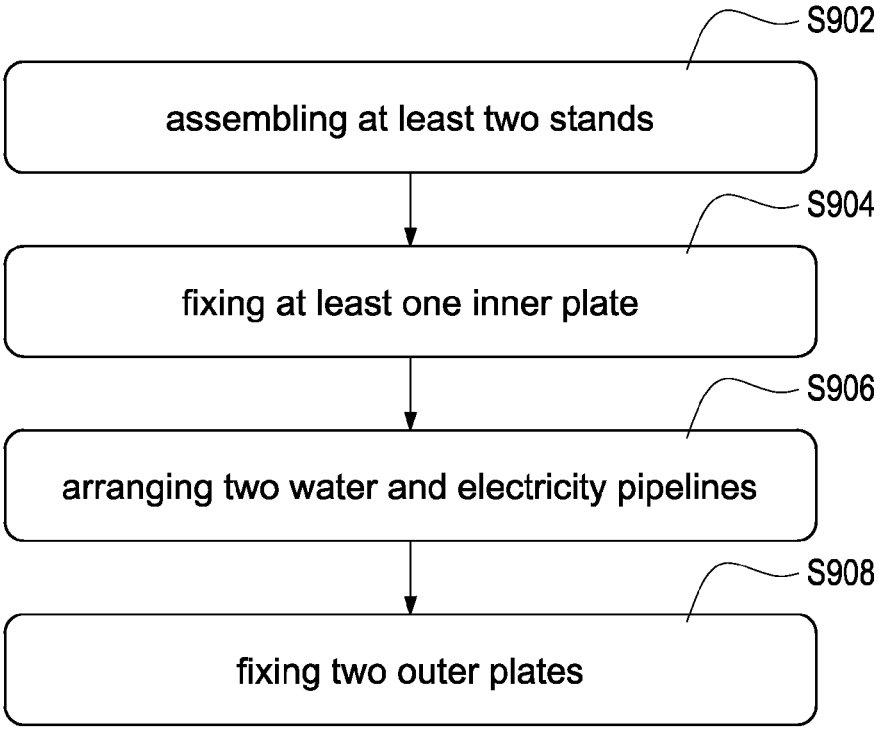
FIG. 22 is a flow chart of a construction method according to the second embodiment of the disclosure.

FIG. 22 shows a flow chart of a construction method according to the second embodiment of the disclosure. The construction method of the second embodiment is similar to that of the first embodiment but some procedures are different. The construction method of the second embodiment comprises the steps of: assembling at least two stands <S902>, wherein the structure of the stand 1 identical to the structure mentioned before; fixing at least one inner plate <S904>, wherein two sides of the inner plate 3 are respectively fixed to and between the two stands 1. Specifically, the left side of the inner plate 3 is plugged into the groove 141 of the left stand 1 while the right side of the inner plate 3 is positioned on the extending plate 142 of the right stand 1; arranging two water and electricity pipelines <S906>, wherein a first water and electricity pipeline and a second water and electricity pipeline are arranged on two surfaces of the inner plate 3; and fixing two outer plates <S908>, wherein the first and second outer plates 4 and 5 are respectively fixed to and between the first panels 11 of the two stands 1 and the second panels 12 of the two stands 1. A first space 6 for accommodating the first water and electricity pipeline is formed between the outer plate 4 and the surface of the inner plate 3 while a second space 7 for accommodating the second water and electricity pipeline is formed between the another outer plate 5 and the another surface of the inner plate 3.

To sum up, the benefits of the disclosure are as follows:

1. The first space 6 and the second space 7 are designed for the water and electricity pipeline to be arranged in without damaging the inner plate 3 so the first and the second space do not connect with each other. Furthermore, the first space 6 and the second space 7 are completely separated by the inner plate 3, which results in better sound insulation effects than the prior art. Even better sound insulation effects can be achieved when the inner plate 3 is made of sound insulation materials 2. Assembling the inner plate 3 does not require any screwing member and does not require any second processing procedure. It can be done by plugging one side of the inner plate 3 into the groove 141 while make the other side lean on the extending plate 142, before plugging the positioning member 144. This makes the construction processes easier. Besides, the first and second spaces 6 and 7 are between the first outer plate 4, the second outer plate 5 and the inner plate 3, which is beneficial to the construction processes.

3. The bending portion 14 and the extending plate 142 make the stand 1 in an E-shaped structure. Compared to the current U-shaped stand, the stand 1 in an E-shaped structure is of better structural strength.

4. A bigger construction space is provided via the design of the first and second spaces 6 and 7. The inner plate 3 does not require any screwing member to be fixed so it can be replaced easily (e.g. replace it with an inner plate 3 made of sound insulation material, fireproof material or form material). In addition, the size of the inner plate 3 can be adjusted if needed, which makes the application more flexible.

5. The bars 2 (the first and second bars 21 and 22) may be designed to install only one of them, to be arranged in a staggered manner, or to install both of them.

6. The first and second water and electricity pipelines in the first and second spaces 6 and 7 may go through the pipeline holes 203 on the first and second bars 21 and 22. Thereby, the first and second water and electricity pipelines can be installed without damaging the sound insulation material of the prior art or without damaging the inner plate 3 of the disclosure. The first and the second spaces 6 and 7 do not connect and the inner plate 3 completely separates the two spaces so the sound insulation effects are better. Even better sound insulation effects can be achieved when the inner plate 3 is made of sound insulation material. Further, this makes the construction process easier.

7. The arrangement of the first bar 21 and the second bar 22 can make the first panel 11 and the second panel 12 both be at the same level, which is beneficial in terms of fixing the first and second outer plates 4 and 5.

8. By disposing one latching member 23 at two ends of the bar 2, the two ends of the bar 2 may be fasten with and fixed to the recessed grooves (161 and 162) of the stand 1 by friction, even without the through holes (151 and 152) on the stand. Additionally, the bar 2 does not protrude from the stand 1.

What is claimed is:

1. A partition comprising:

at least two stands (1) spaced apart from each other, wherein each of the stands (1) comprises a first panel (11), a second panel (12) corresponding to the first panel (11) and a lateral plate (13) connecting the first panel (11) and the second panel (12);

at least one inner plate (3), wherein two sides of the inner plate (3) are respectively fixed to and between the two stands (1); and two outer plates (4, 5) respectively fixed to and between the first panel (11) of each stand (1) and the second panel (12) of each stand (1), wherein the two outer plates (4, 5) and the inner plate (3) form two spaces (6, 7) respectively, wherein the lateral plate (13) is bent to form a bending portion (14) on each stand (1), the bending portion (14) forms a groove (141), an extending plate (142) extends outwardly from a bottom of the groove (141) along a concave direction of the groove (141), one of the two sides of the inner plate (3) is plugged into the groove (141) of one of the stands (1) while the other side of the inner plate (3) is positioned on the extending plate (142) of the other stand (1), and wherein the bottom of the groove (141) is non-coplanar to the lateral plate (13) and an opening direction of the groove (141) faces toward the lateral plate (13).

2. The partition according to claim 1, further comprising a bar (2), wherein the lateral plate (13) of each stand (1) is divided into a first lateral plate (131) and a second lateral plate (132) by the groove (141), at least one first through hole (151) is formed on the first lateral plate (131) of each stand (1) while at least one second through hole (152) is formed on the second lateral plate (132) of each stand (1), and the bar (2) is inserted between the first through hole (151) of each stand (1) or the second through hole (152) of each stand (1), selectively.

3. The partition according to claim 1, wherein at least one socket (143 or 143*a*) is formed on the bending portion (14), the extending plate (142) of each stand (1) comprises at least one positioning member (144 or 144*a*), each of the positioning members (144 or 144*a*) is parallel to the lateral side of the lateral plate (13) and is plugged into the socket (143 or 143*a*) of each stand (1), two sides of the inner plate (3) are respectively disposed between the groove (141) and the positioning member (144 or 144*a*) of one of the stands (1) and between the extending plate (142) and the positioning member (144 or 144*a*) of the other stand (1).

4. The partition according to claim 1, wherein at least one elastic sheet (17 or 17*a*) is disposed on the bending portion (14) of each stand (1), the elastic sheet (17 or 17*a*) protrudes towards the groove (141) and the inner plate (3) is flexibly disposed between the bending portion (14) and the elastic sheet (17 or 17*a*).

5. The partition according to claim 1, wherein the inner plate (3) is made of sound insulation material, fireproof material or foam material.

6. The partition according to claim 1, further comprising a bar structure, wherein the first panel (11), the second panel (12) and the lateral plate (13) of each stand (1) form a recessed groove (16) between them, the bar structure comprises a bar (2) and two latching members (23) disposed on two ends of the bar (2), each of the latching members (23) comprises a latching plate (231) with friction, at least two sides of the latching plate (231) are fastened in the recessed groove (16) of each stand (1) by friction.

* * * * *